United States Patent [19]

Jin

[11] Patent Number: 5,012,216

[45] Date of Patent: Apr. 30, 1991

[54] SUPERCONDUCTIVE GRAVIMETER

[75] Inventor: Korda K. D. Jin, Brea, Calif.

[73] Assignee: Rockwell International Corporation, El Segundo, Calif.

[21] Appl. No.: 484,143

[22] Filed: Feb. 23, 1990

Related U.S. Application Data

[63] Continuation-in-part of Ser. No. 153,740, Feb. 8, 1988, Pat. No. 4,904,971.

[51] Int. Cl.[5] ..... H01F 7/22

[52] U.S. Cl. ..... 335/216; 335/222; 73/382 G

[58] Field of Search ..... 335/216, 222, 223, 224, 335/299; 73/382 R, 382 G

[56] References Cited

U.S. PATENT DOCUMENTS 3,629,753 12/1971 Kawabe et al. ..... 335/216

4,910,486 3/1990 Yumura et al. ..... 335/222

*Primary Examiner*—George Harris

*Attorney, Agent, or Firm*—H. Fredrick Hamann; George A. Montanye; Tom Streeter

[57] ABSTRACT

A superconductive gravimeter comprises a spool (12, 14, 16) and a circumferential magnet (20, 22, 24), both of which are covered with superconductive material (48, 52, 58, 60) except at the magnetic field gaps (54, 56, 62, 64) between them. A force rebalance coil (28, 30) lies in these gaps and supports a superconductive plate (70) above them. Leakage flux flows through the space between the plate and the circumferential magnet. Variations in gravity result in variations in the weight of the plate, resulting in variations in the height of the space, resulting in variations in the flux in the space, which are detected by a pick up coil (74).

4 Claims, 3 Drawing Sheets

SUPERCONDUCTIVE GRAVIMETER

This application is a continuation-in-part of parent application Ser. No. 07/153,740, filed Feb. 8, 1988, entitled "Superconductive Electromagnet," by the same applicant as applicant herein; and said parent application is incorporated herein by reference. Said parent application is now U.S. Pat. No. 4,904,971.

BACKGROUND OF THE INVENTION

The present invention relates to gravimeters, and particularly relates to gravimeters which use superconductivity to function.

A gravimeter is a highly sensitive weighing device used for relative measurement of the force of gravity by detecting small weight differences of a constant mass at different points on the earth, and is also known as a gravity meter. The weight of a large mass will obviously vary more with variations in gravity than will the weight of a small mass. However, this advantage of large masses is offset by the fact that the large apparatus needed to produce the large force to support a large mass is generally less sensitive than is the delicate apparatus needed to produce the small force to support the weight of a small mass. This trade off has limited the senitivity of gravimeters of the prior art.

SUMMARY OF THE INVENTION

It is the objective of the present invention to provide a gravimeter which will measure minute differences in the weight of a fairly large mass.

It is a feature of the present invention that it uses superconductive materials to create a strong magnetic field, most of which is used to support the weight of the mass, and that it measures the remaining, much weaker leakage field for minute changes, which are comparable to the changes in the supporting field.

Other objectives and features will become apparent in view of the following description of a preferred embodiment of the present invention.

DETAILED DESCRIPTION OF A PREFERRED EMBODIMENT

Figure 1:
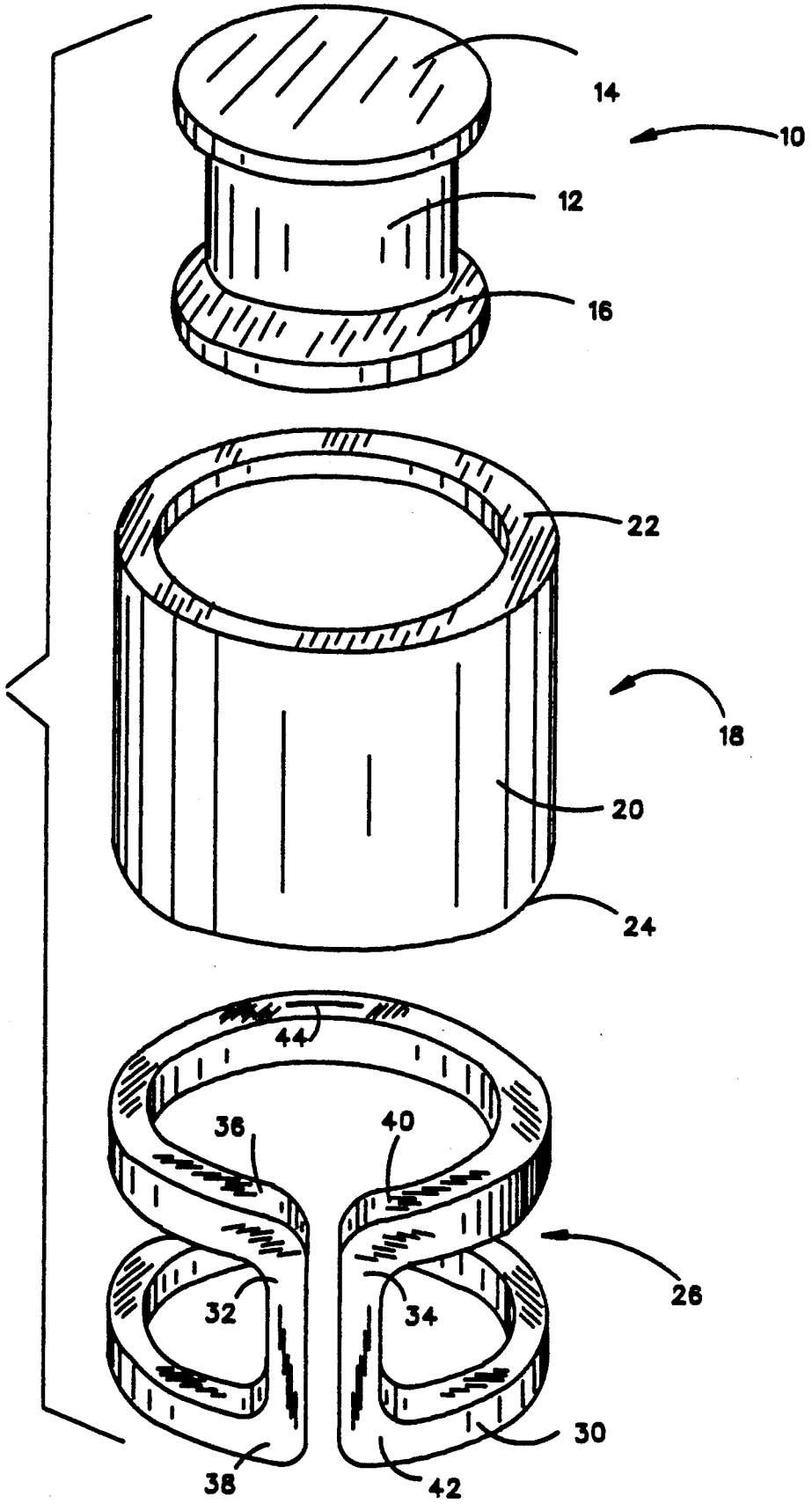
FIG. 1 is an exploded view of three of the major components of a preferred embodiment of the present invention.

Turning now to FIG. 1, a spool 10 comprises a core 12, and upper disk 14, and a lower disk 16. The spool 10 includes a magnetic material, preferably steel, and thus comprises a first magnetic element.

A circumferential magnet 18 comprises a wall 20, an upper annulus 22, and a lower annulus 24. The circumferential magnet 18 also includes a magnetic material, also preferably steel, and thus comprises a second magnetic element.

A force rebalance coil 26 comprises an upper section 28, a lower section 30, a left vertical section 32, and a right vertical section 34. The left vertical section 32 runs between the left end 36 of the upper section 28 and the left end 38 of the lower section 30. The right vertical section 34 runs between the right end 40 of upper section 28 and the right end 42 of lower section 30.

The force rebalance coil 26 may be conceived of as a coil of wire 44 wrapped in the shape of a vertical rectangle instead of in the more common shape of a circle, with the width of the rectangle being considerable greater than its height. The plane of the rectangle is then curved into a vertical cylinder, so that the horizontal sections 28 and 30 of the rectangle become circles, and the vertical sections 32 and 34 remain vertical line segments. The foregoing conceptual description is also a suitable manufacturing method.

Figure 2:
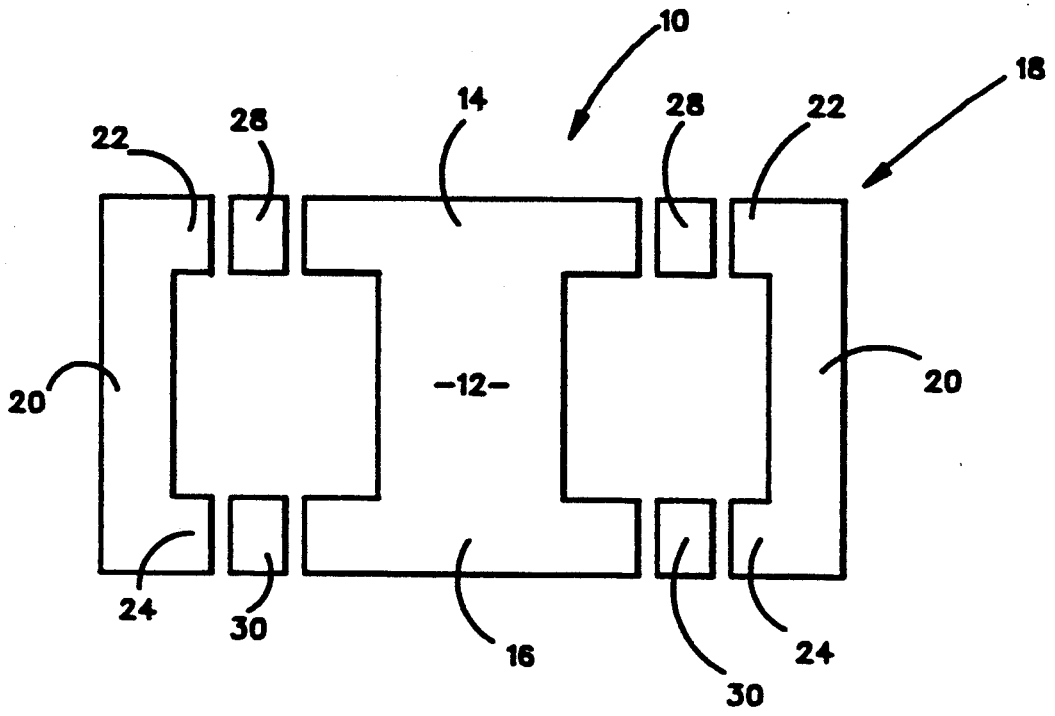
FIG. 2 shows an axial cross-section of the three components of the embodiment of FIG. 1, after assembly.

The spool 10, circumferential magnet 18, and force rebalance coil 26 are coaxial and concentric when assembled, with the upper section 28 of the force rebalance coil 26 fitting between the upper disk 14 of the spool 10 and the upper annulus 22 of the circumferential magnet 18, and the lower section 30 of the force rebalance coil 26 fitting between the lower disk 16 of the spool 10 and the lower annulus 24 of the circumferential magnet 18. A cross-section of the spool 12, circumferential magnet 18, and force rebalance coil 26, showing their relative positions when assembled, appears as FIG. 2.

Figure 3:
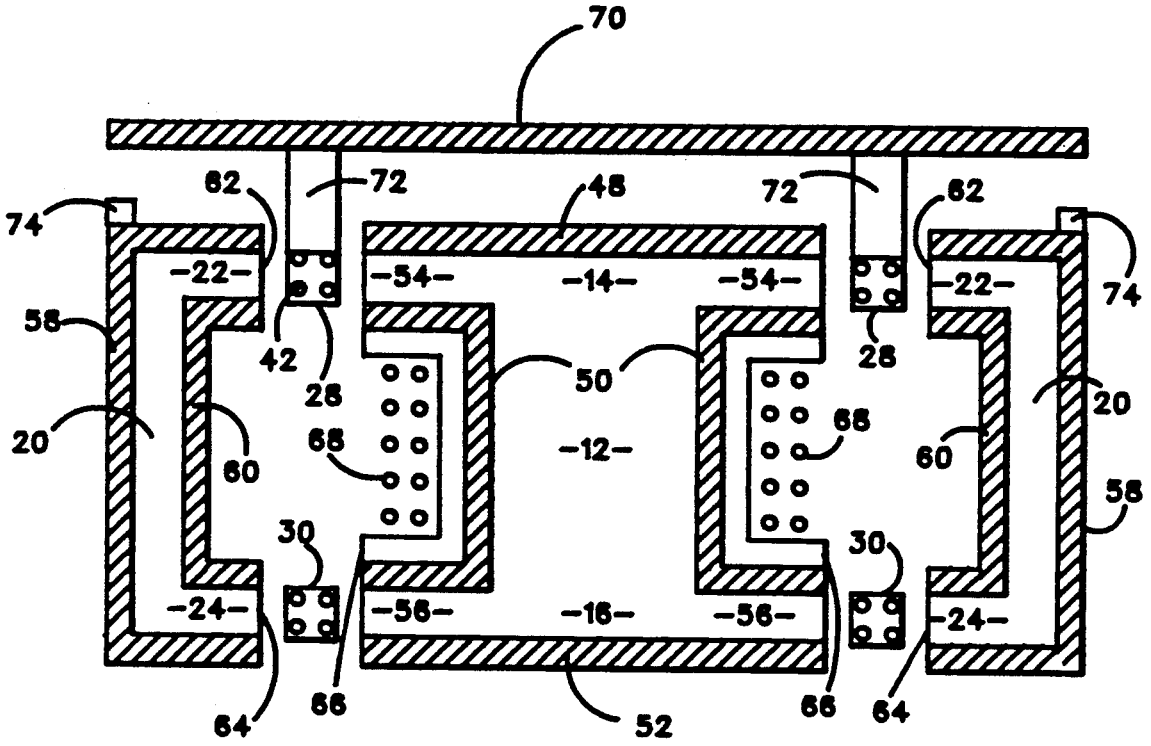
FIG. 3 is comparable to FIG. 2, and shows an axial cross-section of the completed embodiment of the present invention partially shown in FIGS. 1 and 2.

Turning now to FIG. 3, the spool 10 is partly covered with three layers of superconductive material. An upper layer 48 of superconductive material covers the upper surface of the upper disk 14. An outer layer 50 covers the outer surface of the core 12, the lower surface of the upper disk 14, and the upper surface of the lower disk 16. A lower layer 52 of superconductive material covers the lower surface of the lower disk 16.

Thus, the entire spool 10, the first magnetic element, is covered on its surface, the first surface, with a first layer of superconductive material. The only exceptions are for the upper spool face 54 facing the upper section 28 of the force rebalance coil 26, and the lower spool face 56 facing the lower section 30 of the force rebalance coil 26. Magnetic flux leaves the upper spool face 54, and the first layer thus defines a first region for leaving magnetic flux. Magnetic flux enters the lower spool face 56, and the first layer thus defines a first region for entering magnetic flux.

The outer layer 50 around the core 12 is covered with a thermally insulating layer 66, around which is wound a spool wire 68. The insulating layer 66 insulates the outer layer 50 from the heat produced by the spool wire 68 when current flows through it.

Likewise, the circumferential magnet 18 is partly covered with two layers of superconductive material. An exterior layer 58 covers the exterior surface of the wall 20, the upper surface of the upper annulus 22, and the lower surface of the lower annulus 24. An interior layer 60 covers the interior surface of the wall 20, the lower surface of the upper annulus 22, and the upper surface of the lower annulus 24.

Thus, the entire circumferential magnet 18, the second magnetic element, is covered on its surface, the second surface, with a second layer of superconductive material. The only exceptions are for the upper annular face 62 facing the upper section 28 of the force rebalance coil 26, and the lower annular face 64 facing the lower section 30 of the force rebalance coil 26. Magnetic flux leaves the lower annular face 64, and the second layer thus defines a second region for leaving magnetic flux. Magnetic flux enters the upper annular face 62, and the second layer thus defines a second region for entering magnetic flux.

The upper faces 54 and 62 lie proximate each other, so as to concentrate the magnetic flux flowing across the upper section 28 of the force rebalance coil 26. Likewise, the lower faces 56 and 64 lie proximate each other, so as to concentrate the magnetic flux flowing across the lower section 30 of the force rebalance coil 26. In both cases, the force rebalance coil 26 comprises a means for carrying current between the affected faces, but not from either face to the other. Instead, the current is carried in a direction perpendicular to the direction from each face to the other.

A superconductive plate 70, a third layer of superconductive material, is supported, proximate the superconductive exterior layer 58 on the upper surface of the upper annulus 22 of the circumferential magnet 18, by an annular support 72. The support 72 is in turn supported by the upper section 28 of the force rebalance coil 26.

A pickoff coil 74 rests upon the superconductive exterior layer 58 on the upper surface of the upper annulus 22 of the circumferential magnet 18. It therefore comprises a means for measuring variations in magnetic flux between the exterior layer 58 and superconductive plate 70.

Operation of the gravimeter is apparent from the foregoing description of its structure. The gravimeter is cooled to just above the critical temperature of its superconducting elements, and currents of suitable strength are directed both through the force rebalance wire 44 and the spool wire 68. "Suitable strength" is whatever is necessary for the combined weight of the plate 70, support 72, and force rebalance coil 26 to be counteracted by the force on the force rebalance coil 26 imposed by the magnetic field between the spool 10 and the circumferential magnet 18.

It is apparent from the left hand rule that flux directed outward from the upper spool face 54 to the upper annular face 62 will interact with the current flowing through the upper section 28 of the force rebalance coil 26 and force it upward. Likewise, flux directed inward from the lower annular face 64 to the lower spool face 56 will interact with the current flowing in the opposite direction through the lower section 30 of the force rebalance coil 26 and force it upward, as well.

The gravimeter is then cooled. The outer superconductive layer 50 on the spool 10, being insulated from the spool wire 68 by the thermal insulating layer 66, will become superconductive, and will confine whatever magnetic flux the spool wire 68 has created within the core 12. Once the flux is thus confined, the current in the spool wire 68 may be cut off. Likewise, the current in the force rebalance wire 44 can be cut off whenever the gravimeter is not producing readouts. It is then necessary to restore the original current so that the force rebalance coil 26 will float in the flux between the faces 54 and 62, and the faces 56 and 64.

In general, this magnetic flux will flow upward through the core 12 and outward through the upper disc 14. It will be unable to escape through the superconductive upper layer 48 on the upper surface of the upper disk 14, and will flow outward through the upper spool face 54, through the upper section 28 of the force rebalance coil 26, and into the upper annulus 22 through the upper annular face 62. The superconductive exterior layer 58 and interior layer 60 will not allow it to enter anywhere else.

The flux then flows downward through the wall 20 and inward through the lower annulus 24, all the while being unalbe to escape through either the superconductive exterior layer 58 or the superconductive interior layer 60. It continues inward across the lower annular face 64, through the lower section 30 of the force rebalance coil 26, and into the lower disc 16 through the lower spool face 56. It then goes upward again through the core 12.

While the above description has been in terms of flux rising through the spool 10, and falling through the circumferential magnet 18, it is apparent that this direction could be reversed, reversing with it the direction of the current thought the force rebalance wire 44.

Once the flux enters a face 62 or 56, it must remain in the circumferential magnet 18 or spool 10 until it leaves by the opposite face 64 or 54. However, there will inevitably be some leakage flux which, instead of entering the upper annulus 22 from the upper disc 14, instead enters the upper annulus 22 from above, from the gap between the upper annulus 22 and the superconductive plate 70. If the plate 70 is pressed closer to the upper annulus 22, as by a minute change in gravity, this gap will be smaller, and the leakage flux will, instead, have to enter the upper annulus 22 from below, from the space between the superconductive outer layer 50 on the spool 10 and the superconductive interior layer 60 on the circumferential magnet 18. This change in leakage flux will be detected by the pickoff coil 74, and the resulting signal may be amplified conventionally, preferably by means of a superconducting quantum interference device, or SQUID.

It is apparent that the combined mass, and thus the combined weight, of the force rebalance coil 26, annular support 72, and superconductive plate 70 may be adjusted to any convenient value. Such adjustment may be made by suitable sizing and materials choice, or (if desired) by adding a convenient mass (which may or may not be superconducting) to any of these elements, although the superconductive plate 70 generally makes the most convenient substrate for same.

The sensitivity of the present invention comes about from absolutely confining a fixed magnetic flux within the spool 10, from absolutely confining a slightly different fixed magnetic flux within the circumferential magnet 18, spool 10, and from forcing a part of the excess flux to pass between the superconductive plate 70 and superconductive upper annulus 22. Minute differences in the combined weight of the force rebalance coil 26, annular support 72, and superconductive plate 70 greatly affect this excess flux and may thus be accurately detected by the pickoff coil 74.

INDUSTRIAL APPLICABILITY

The present invention is capable of exploitation in industry, and may be used, in any situation in which a conventional gravimeter may be used and in which a source of electricity and cryogenic temperatures is available. It may be made of steel or any other material which is sufficiently strong, and has a sufficiently low magnetic reluctance, as to provide support for the force rebalance coil 18 and associated elements.

The foregoing description is only of a particular embodiment of the present invention, and is not a description of the present invention itself, the true scope and spirit of which is set forth in the following claims.

What is claimed is:

1. A superconductive gravimeter comprising:

a first magnetic element having a first surface;

a first layer of superconductive material on said first surface, defining a first region for entering magnetic flux and a first region for leaving magnetic flux;

a second magnetic element having a second surface;

a second layer of superconductive material on said second surface, defining a second region for entering magnetic flux and a second region for leaving magnetic flux, said second entering region lying proximate said first leaving region, and said second leaving region lying proximate said first entering region;

means for carrying a current between said second entering region and said first leaving region, or means for carrying a current between said first entering region and said second leaving region, in a direction perpendicular to the direction from said entering region to said leaving region;

a third layer of superconductive material, supported by said current carrying means, proximate said second layer of superconductive material;

means for mesauring variations in magnetic flux between said second layer of superconductive material and said third layer of superconductive material.

2. A superconductive gravimeter comprising:

a spool having an upper surface, an outer surface, a lower surface, an upper spool face between said upper surface and said outer surface, and a lower spool face between said lower surface and said outer surface;

an upper layer of superconductive material on said upper surface, an outer layer of superconductive material on said outer surface, a lower layer of superconductive material on said lower surface, an upper spool face between said upper surface and said outer surface, and a lower spool face between said lower surface and said outer surface;

a circumferential magnet having an interior surface and an exterior surface;

a interior layer of superconductive material on said interior surface, an exterior layer of superconductive material on said exterior surface, an upper annular face between said interior surface and said exterior surface proximate said upper spool face, and a lower annular face between said interior surface and said exterior surface proximate said lower spool face;

a force rebalance coil for carrying a current between said upper faces, or for carrying a current between said lower faces, in a direction perpendicular to the direction from said spool face to said annular face;

a superconductive plate, supported by said force rebalance coil, proximate said exterior layer;

a pickoff coil for mesauring variations in magnetic flux between said exterior layer and said plate.

3. The superconductive gravimeter of claim 2, further comprising:

a thermally insulative layer exterior to said superconductive outer layer on said spool; and a spool wire wound around said insulative layer.

4. A method for operating a superconductive gravimeter, comprising:

establishing, above the critical temperature, a magnetic field between two pieces of magnetic material, the nonpolar surfaces of each of which are covered with a layer of superconductive material;

placing a force rebalance coil in said field, said force rebalance coil supporting a superconductive plate;

cooling said layers of superconductive material and said superconductive plate to a temperature below said critical temperature; and measuring variations in magnetic flux flowing between a layer of superconductive material and said superconductive plate.

* * * * *